US007942176B1

(12) United States Patent
Good

(10) Patent No.: US 7,942,176 B1
(45) Date of Patent: May 17, 2011

(54) DRUM SHELL FORMATION

(75) Inventor: John J. Good, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 296 days.

(21) Appl. No.: 12/154,650

(22) Filed: May 27, 2008

(51) Int. Cl.
*B27H 1/00* (2006.01)

(52) U.S. Cl. ..... 144/381

(58) Field of Classification Search ..... 144/254, 144/255, 256.2, 256.3, 259, 261, 269, 270, 144/271, 380, 381; 100/210, 211, 316, 317, 100/325, 326; 425/325, 326, 449, 233, 532, 425/405, 384, 393
See application file for complete search history.

(56) References Cited

U.S. PATENT DOCUMENTS

| | | | | | |
|---|---|---|---|---|---|
| 1,379,203 | A | * | 5/1921 | Mundale | 425/20 |
| 2,279,820 | A | * | 4/1942 | Hamilton | 144/348 |
| 2,311,561 | A | * | 2/1943 | Miller | 144/254 |
| 2,365,754 | A | * | 12/1944 | Gramelspacher | 144/349 |
| 2,458,864 | A | * | 1/1949 | Lindsay | 156/224 |
| 2,459,316 | A | * | 1/1949 | Gramelspacher | 29/421.1 |
| 3,087,390 | A | * | 4/1963 | Ruza | 425/393 |
| 3,268,635 | A | * | 8/1966 | Kraus et al. | 264/41 |
| 3,351,978 | A | * | 11/1967 | Kraus et al. | 425/449 |
| 3,776,679 | A | * | 12/1973 | Hegler | 425/532 |
| 3,784,152 | A | * | 1/1974 | Garner et al. | 249/80 |
| 4,102,236 | A | * | 7/1978 | North | 84/411 R |
| 5,059,109 | A | * | 10/1991 | Dickhut et al. | 425/233 |
| 5,123,465 | A | | 6/1992 | Gabriel | |
| 5,573,787 | A | * | 11/1996 | Lupke et al. | 425/233 |
| 5,871,171 | A | * | 2/1999 | Kenney et al. | 242/610.4 |
| 6,126,560 | A | * | 10/2000 | Maruoka et al. | 473/409 |
| 6,652,258 | B1 | * | 11/2003 | Starita | 425/195 |
| 7,081,576 | B1 | * | 7/2006 | Daoud | 84/411 R |

* cited by examiner

*Primary Examiner* — Dana Ross
*Assistant Examiner* — Jennifer Chiang
(74) *Attorney, Agent, or Firm* — William W. Haefliger

(57) ABSTRACT

In the method of forming a drum shell that consists of plywood, the steps that includes forming the shell under pressure and heat into cylindrical configuration, providing inner and outer cooling platens adapted to respectively engage the interior and exterior surfaces of the heated shell, trapping the heated shell between the platens, at elevated pressure, allowing the shell to cool by heat transfer from shell side wall or walls into pressure exerting side walls, and while trapped between such platens, at elevated pressure, and removing the cooled shell from between the cooling platens.

14 Claims, 7 Drawing Sheets

WOOD SHELL COOLED BY HEAT TRANSFER FROM HOT SHELL TO COOLED PLATENS

DRUM SHELL FORMATION

BACKGROUND OF THE INVENTION

This invention relates generally to the formation of drum shells consisting of wood, such as plywood; and more particularly the invention concerns cooling of shells after their formation in annular configuration, under heat and pressure.

Multi ply drum shells are typically made of plywood consisting of single ply, 2 ply and 3 ply cross laminate lay ups. Drum shells may consist of a combination of those factors.

When such plies are rolled together with glue (or any type of adhesive) and inserted into a mold, there are two elements that work together to form the shell-pressure and heat. The mold (also known as a heating device or drum shell machine) typically has an outer platen and an inner platen, which work via hydraulics, as well as serving as heating elements. The outer platen closes to establish the outside diameter of the shell. The inner platens, provided with a tapered pin to displace them, spreads the inner platens toward the outer platens, thus trapping the plywood (shell) in between the inner and outer platens at roughly 200 degrees Fahrenheit, heat and pressure working together to form the inner diameter of the shell.

The shells typically remain in this heating device under about 2,500 psi. of hydraulic pressure for 5.5 (five and one-half) minutes. Adhesives that are used to bond the plywood typically activate under heat and pressure. Substantially constant pressure is an important element, besides the heating process. After the shell has been properly heated and molded, the pressure from the inner platen and then from the outer platen is relieved, releasing the shell, which is removed from the heating device. Typically, at this stage the drum shell is then placed on a cold cement floor and another shell is loaded into heater, for treatment.

It has been found that the cold cement floor cools the shell from the floor, such cooling traveling up the shell to create a colder and cured shell by the time it reaches the top of shell. During that process, the annular shape of the drum shell can and does distort leading to problems in use of the final drum.

It is vital for drums shell to be round and hard. The roundness helps the tuning process of the drum i.e. having the drum head centered, top and bottom, to achieve maximum tunability, with bearing edges for drum heads on a flat and even plane. The hardness of the shell is necessary to allow the hollow interior chamber to vibrate freely and with continuity in use. Between these objectives lies the possibility for a successful sounding tuned drum shell. In the past it was found that the success of realizing both these elements or characteristics was only achieved by hit and miss, hoping that the elements would come together naturally. However, through many years of experience and research it was discovered that the failure rate of realizing both of these two elements is fairly high i.e.; dry whether, cold-damp weather, heat, moisture, wind as well as many other influential elements contributed to the failure or rejection rates of drum shells. There is need for a new process that virtually ensures a consistent manufacturing process to consistently realize these objectives.

All drums are exposed to extreme variations in temperature due to a wide variety of elements. Most commonly these include exposure to a hot concert stage, then packing into a cold truck, and then returning to a hot, dry or moist environment. Due to such repeated exposures the potential for the drum shell to go out of round is quite high, absent starting off with as perfectly round a drum shell as possible, ultimately threatening the integrity of the sound.

There is need to prevent such uneven cooling of the heat and pressure formed plywood shells, in an efficient reliable manner. Also, there is need to significantly speed up the over-all process of heating and cooling plywood drum shells. Further, there is need to prevent distortion of the plywood shell as it cools.

SUMMARY OF THE INVENTION

It is a major object of the invention to provide an improved method of forming plywood drum shells, meeting the above needs, and overcoming distortion problems, as referred to.

Basically, the overall method of plywood drum shell formation, in accordance with the invention comprises:

a) forming the plywood shell under pressure and heat into cylindrical configuration, b) providing inner and outer cooling platens adapted respectively to engage the interior and exterior surfaces of the heated shell, c) trapping the heated shell between such cooling platens, at elevated pressure, d) allowing the shell to cool while trapped between the platens, at elevated pressure, e) and removing the cooled shell from between the cooling platens.

As will be seen, the method typically includes transferring heat from the shell side walls to the cooling platens, whereby cooling takes place substantially from all shell side walls, sidewardly, instead of endwise from one end only of the shell. Cooling efficiency at sides of the shell is enhanced by maintaining the shell in radial compression, on all sides, during such cooling. In particular, such heat transfer from the shell to the inner platen is preferred, whereby the shell is cooled radially, as from its inner side toward its outer side. The relatively small radial thickness of the shell serves to enhance the rapidity of cooling, and at substantially the same rate and at substantially the same time, over the entirety of the shell, which is maintained under pressure to eliminate warpage during cooling. Accordingly, shell temperatures, at different portions of the shell, decrease at substantially the same rate or rates toward ambient temperature, in the overall cooling zone.

Other objects include platen configurations as circular segments, and provision for cooling fluid flow through the platens.

Yet another object is to provide apparatus for treating plywood drum shells to enhance consistency of manufactured drum shell quality, and rapidity of multiple shell production, the apparatus comprising a) a first bank of platens operable to receive plywood blanks to form the blanks into annular drum shape, under elevated temperature and pressure, b) a second bank of platens operable to receive the shells removed from the first bank of platens, and having means to rapidly and substantially uniformly cool the received shells by heat transfer in shell thickness directions, and under elevated pressure, c) the cooled shells then being removed from the second bank of platens.

These and other objects and advantages of the invention, as well as the details of an illustrative embodiment, will be more fully understood from the following specification and drawings, in which:

DRAWING DESCRIPTION

FIG. 1 shows a first bank of drum shell heating units, and a second bank of drum shell cooling units, for parallel heating and cooling processing of drum shells;

FIGS. 2 & 3 diagrammatically show first inner and outer platen sections forming a plywood blank into semi-circular shape;

DETAILED DESCRIPTION

Figure 1:
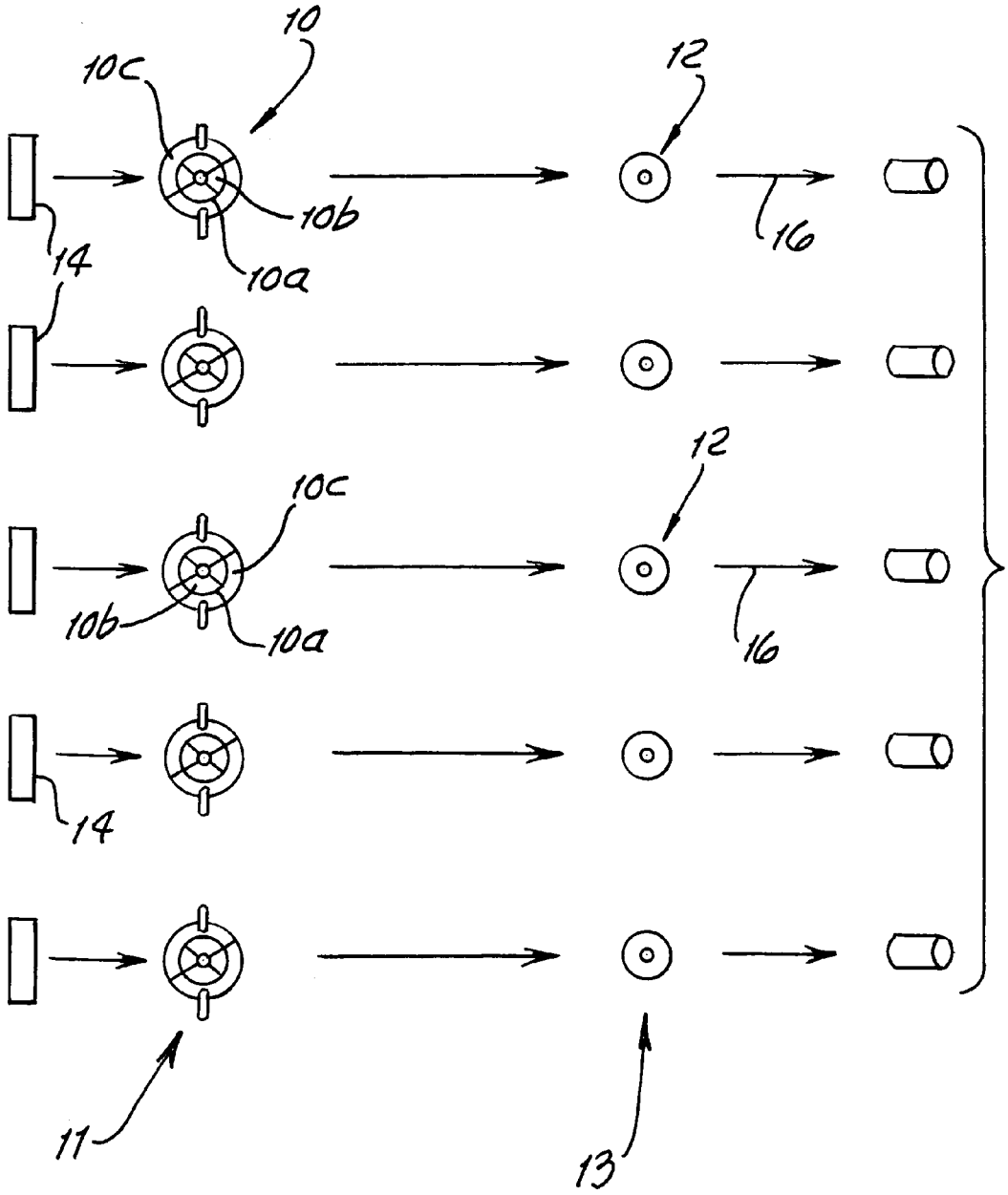

In FIG. 1, a first bank of drum shell heating platens 10 is shown at 11; and a second bank of drum shell cooling platens 12 is shown at 13. Plywood blanks 14 are received by and between inner and outer platens, as at 10*a*, to receive heat and pressure to adhesively bond the plies together in cylindrical configuration. Inner platen cylindrical segments appear at 10*b*, and outer platen cylindrical segments appear at 10*c*. After time T between the platens 10, the latter are adjusted to allow removal of the formed hot shells, and transfer thereof to the cooling inner and outer platens 12. Therein, heat is withdrawn from the shells, kept at high pressure exerted against inner and outer side walls of the shells, i.e. maximum heat transfer wall area with surface-to-surface contact is utilized for efficient, uniform, and rapid cooling, without distortion. Platens 12 are like platen 10, but are kept cooled.

Thereafter, the shells are removed from bank 13, as shown at 16. During such cooling in bank 13, the bank 11 is again used to heat form, under pressure, another set of shells, for rapid, efficient, production.

Figure 2:
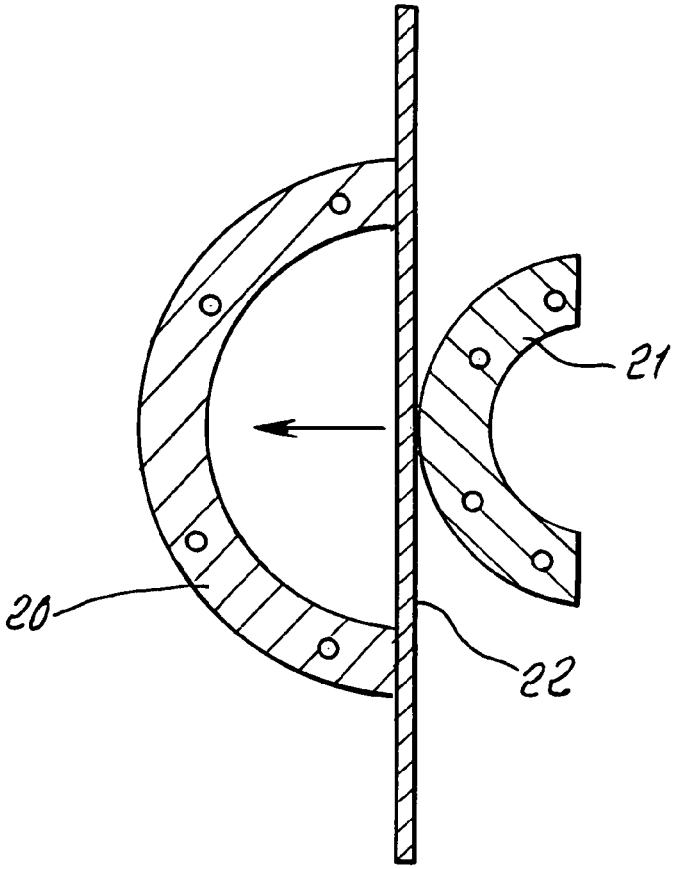
Figure 3:
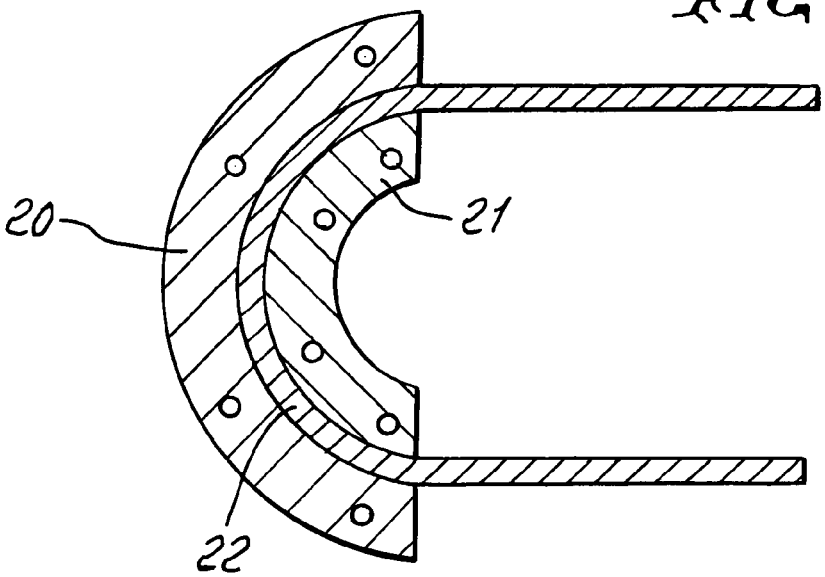
Figure 4:
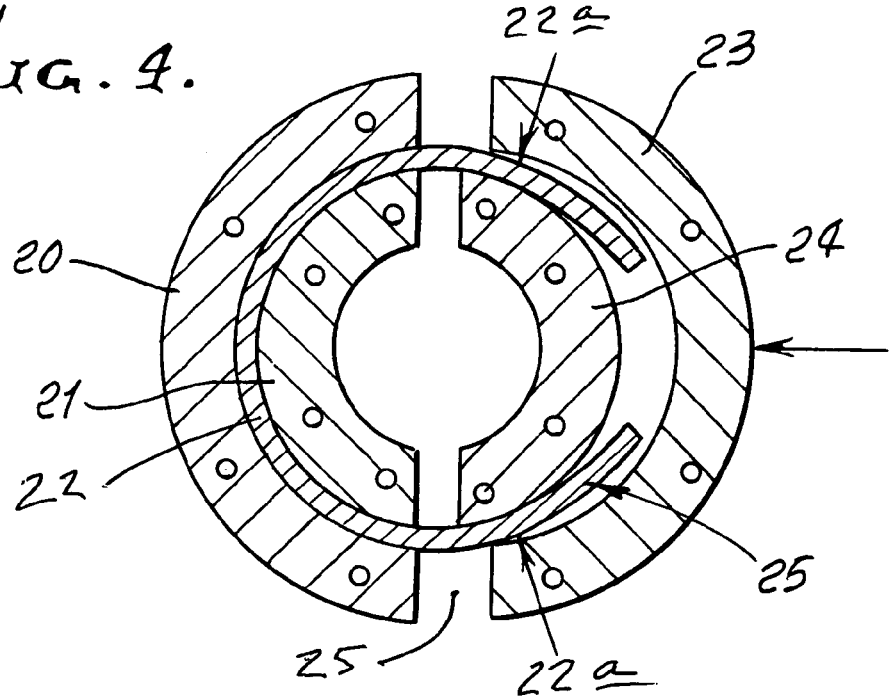
FIGS. 4 & 5 show first inner and outer platen sections completing formation of the plywood blank into cylindrical shape.
Figure 5:
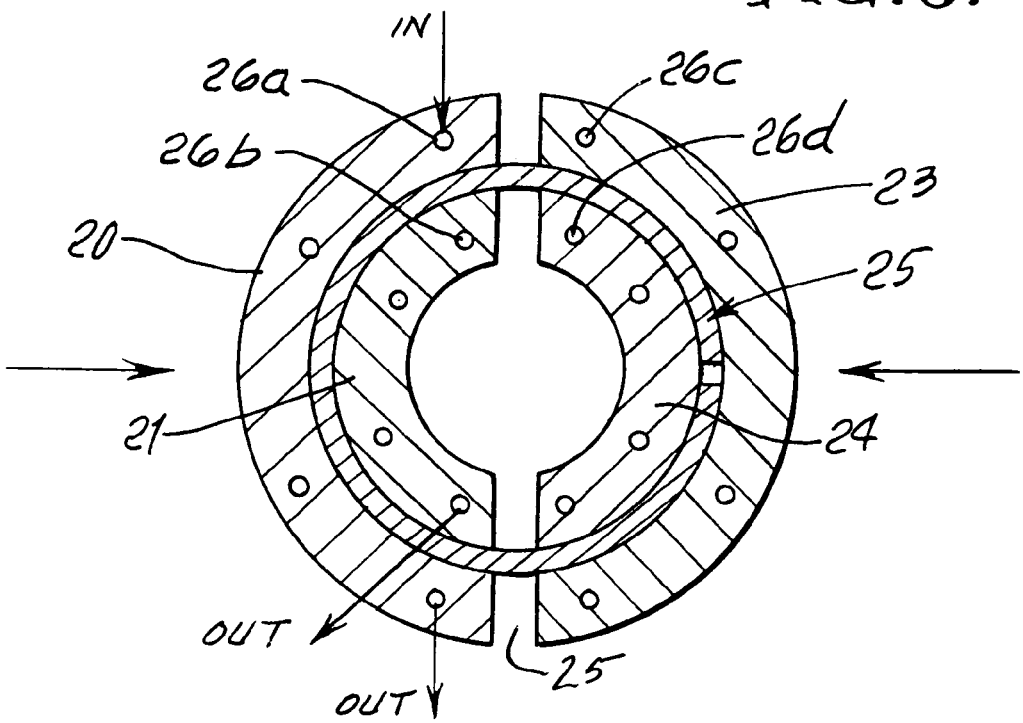
Figure 6:
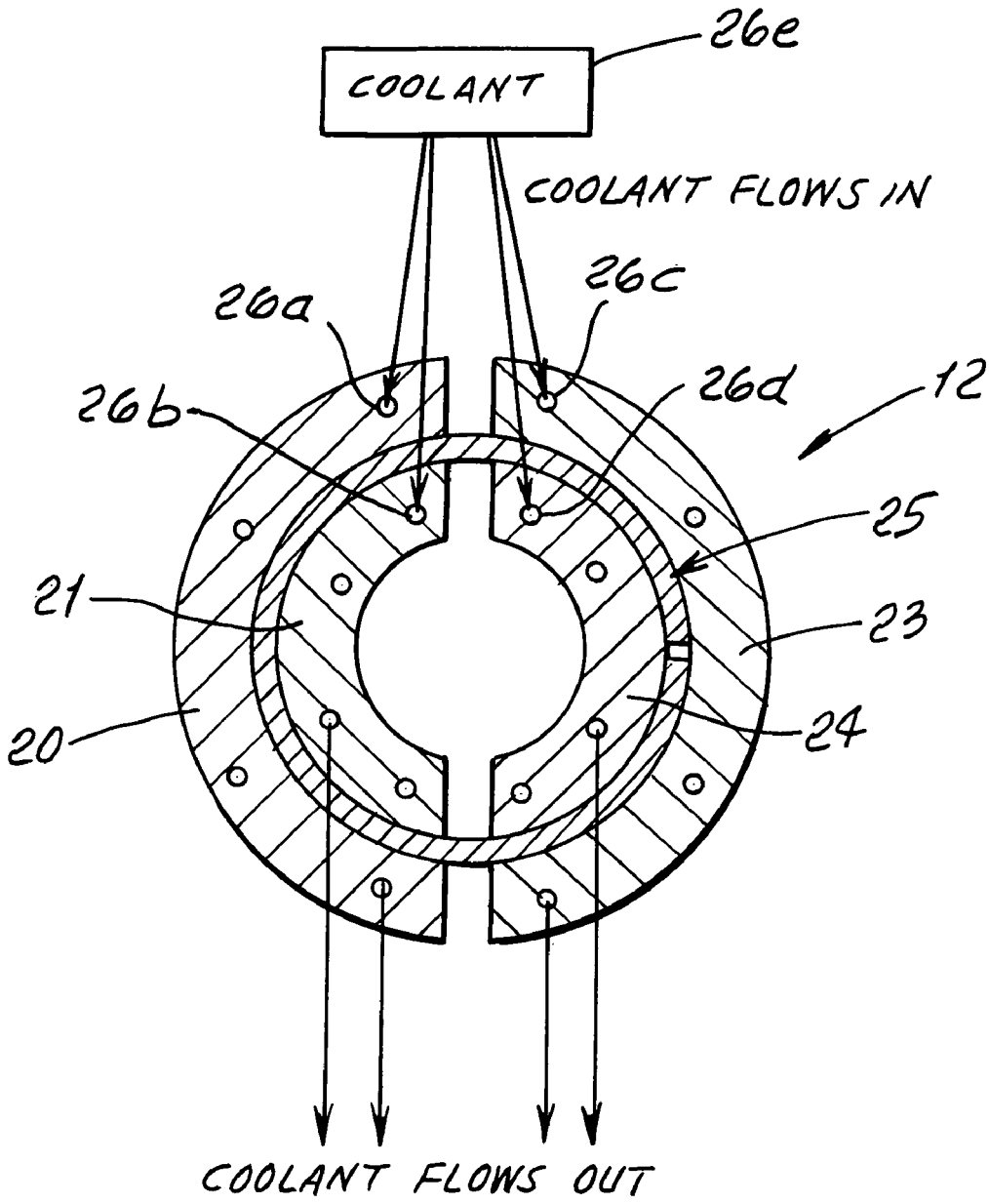
FIG. 6 is like FIG. 5 but shows preferred cooling of the captivated plywood cylinder.

FIGS. 2 and 3 schematically show one way of operating, with provision of first inner and outer platens segments 20 and 21 displaced toward one another to form a plywood blank 22 into semi-circular configuration; and FIGS. 4 and 5 show first inner and outer platen segments 20, 21, 23 and 24 relatively displaced to complete the formation of the annular or substantially cylindrical shell 25. The segments may be pie shaped, as in FIG. 10. Heat is typically supplied to the metallic platens, as via tubing 26, 26*a*, 26*b*, 26*c* and 26*d* for hot fluid such as water, and pressure is applied to inner segments 21 and 24 as by a central plug 30 seen in FIG. 10. Heating at temperature of about 200° F., for between 5 and 6 minutes under pressure exertion of about 2,500 psi, optimizes shell formation. The inner and outer platens are then relatively displaced, radially, to allow removal of the formed hot shell, for cooling between the second inner and outer cooling platens 12 as seen in FIG. 6, and also in FIG. 1.

The platen 12 is like the platen 10, except that coolant liquid flows through tubing 26, 26*a*, 26*b*, 26*c* and 26*d*. A source of such coolant appears at 26*e*. Heat is rapidly extracted from the hot shell, due to the metallic masses of the platens, (at least 5-10 times thicker in radial dimension than the captivated shell 25) and also due to the high face to face pressure (about 2,500 psi) exerted upon the side wall or walls of the shell. Such cooling occurs at substantially the same rate of heat transfer from all wall portions of the shell, into the cold platens, kept at temperatures between 68° F. and 35° F. Cooling time varies for different size shells, but is normally between 2 and 5 minutes. After completion of cooling, the inner and outer platen segments are relatively separated to allow shell removal, the shells being near ambient temperature.

Steps of the overall method include:

a) providing first inner and outer shell forming platens, b) trapping plywood between the platens at elevated temperature and pressure to annularly form the drum shell, c) providing second inner and outer shell cooling platens, d) trapping the formed shell in heated state between the second platens at elevated pressure, e) allowing the shell to cool between the second platens, by heat transfer sidewardly of the shell to second platens, while remaining at elevated pressure, f) removing the cooled shell from between the inner and outer second platens.

Figure 7:
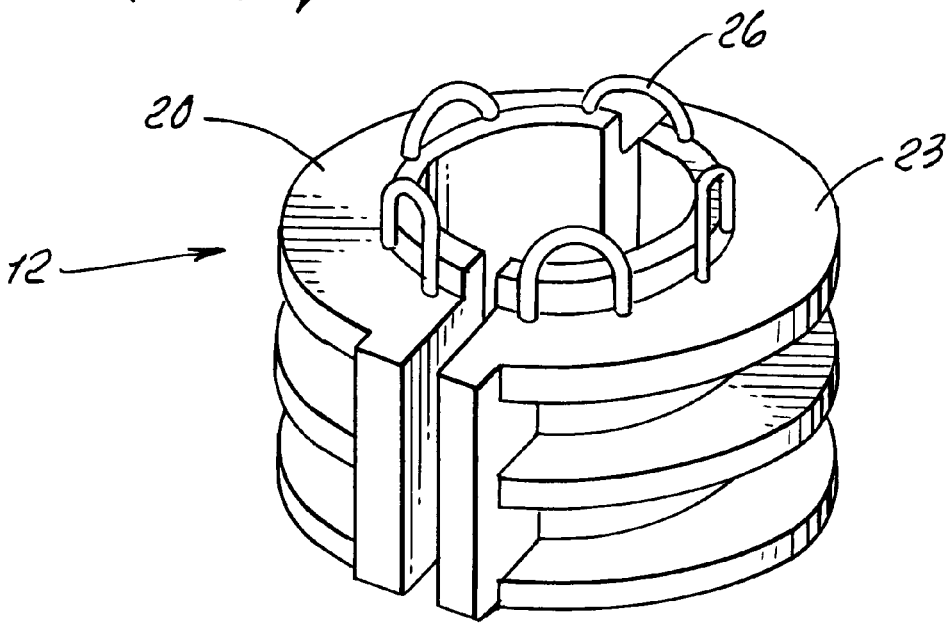
FIG. 7 is a perspective view of an actual platen assembly.
Figure 9:
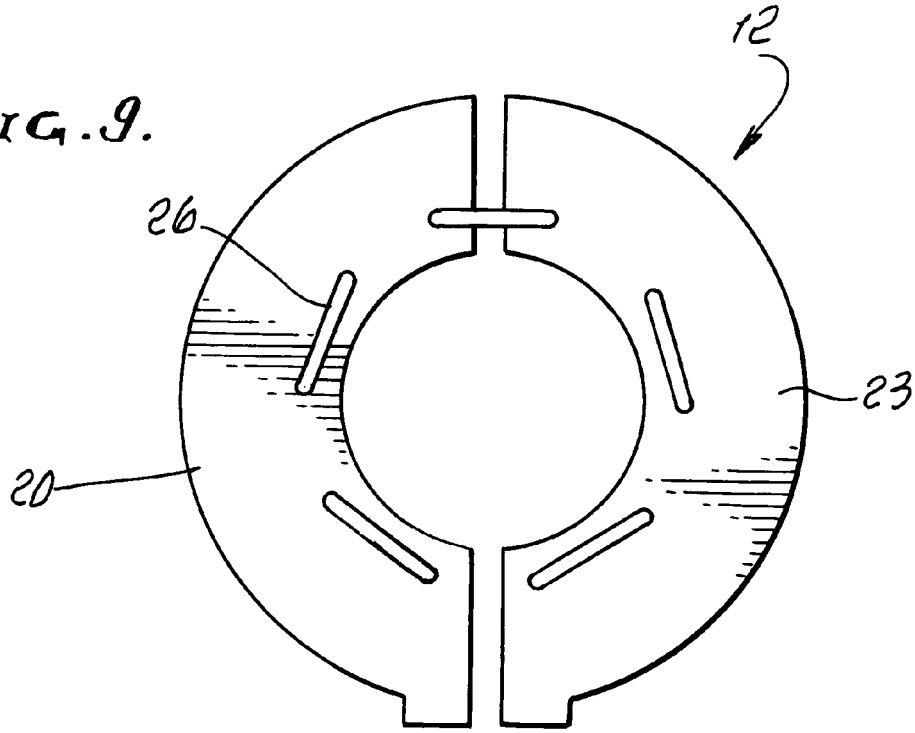
FIG. 9 is a top plan view of the outer platens, showing locations of the tubing.
Figure 8:
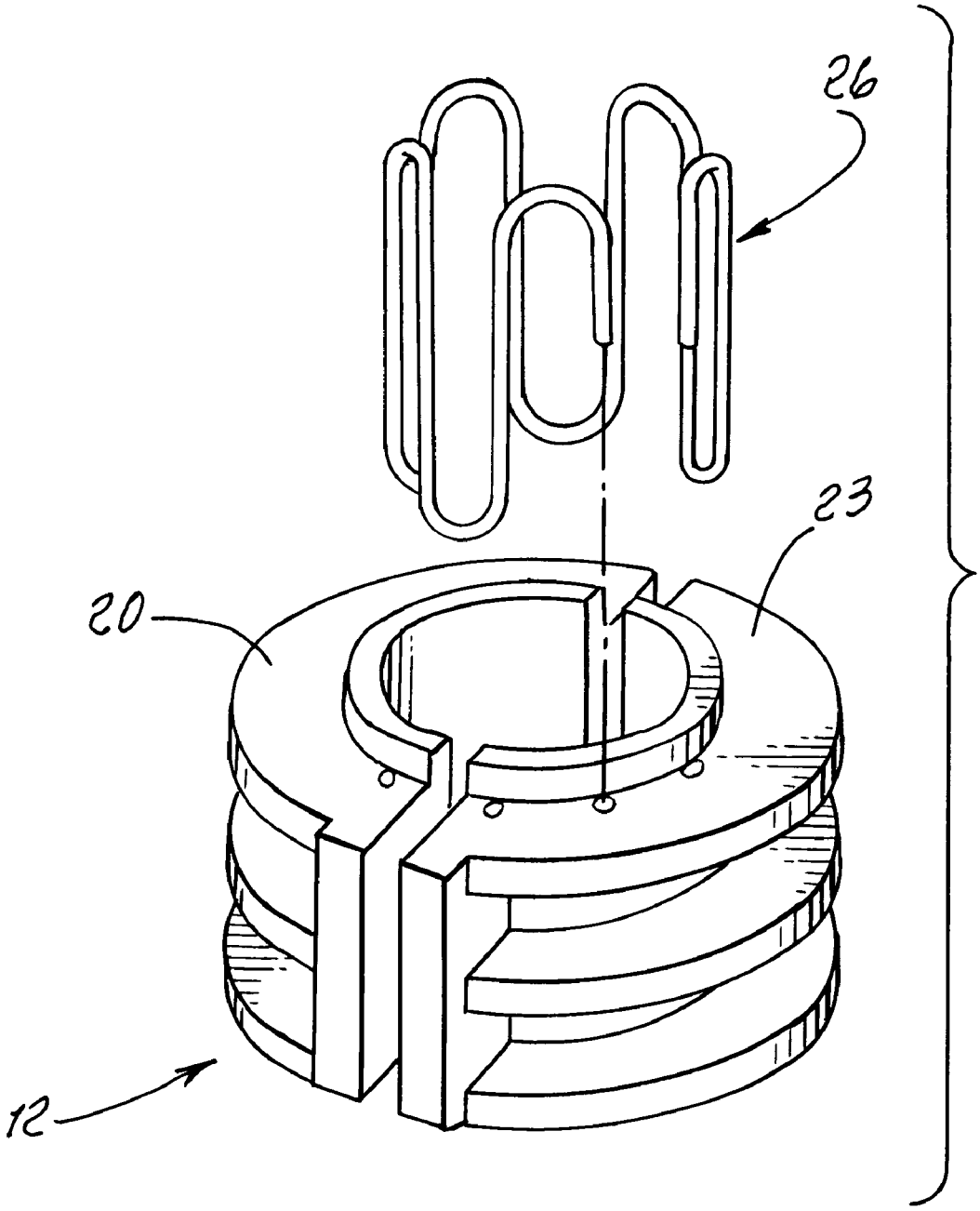
FIG. 8 is a perspective view like FIG. 7, with tubing for heat transfer fluid displaced endwise.
Figure 10:
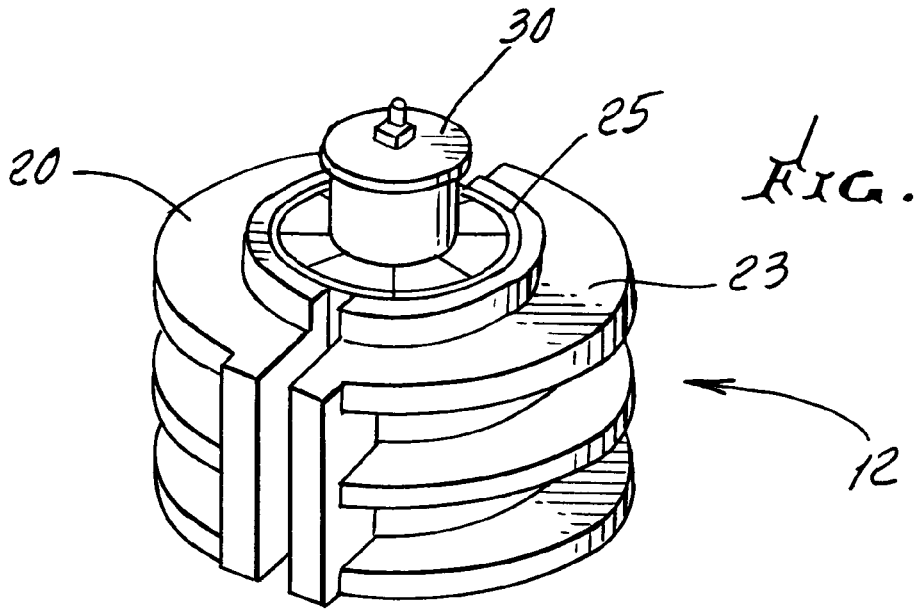
FIG. 10 is a top perspective view showing inner and outer platens with annular plywood there between, and a pressure transmitting plug being received axially downwardly into a recess formed by inner platforms.
Figure 11:
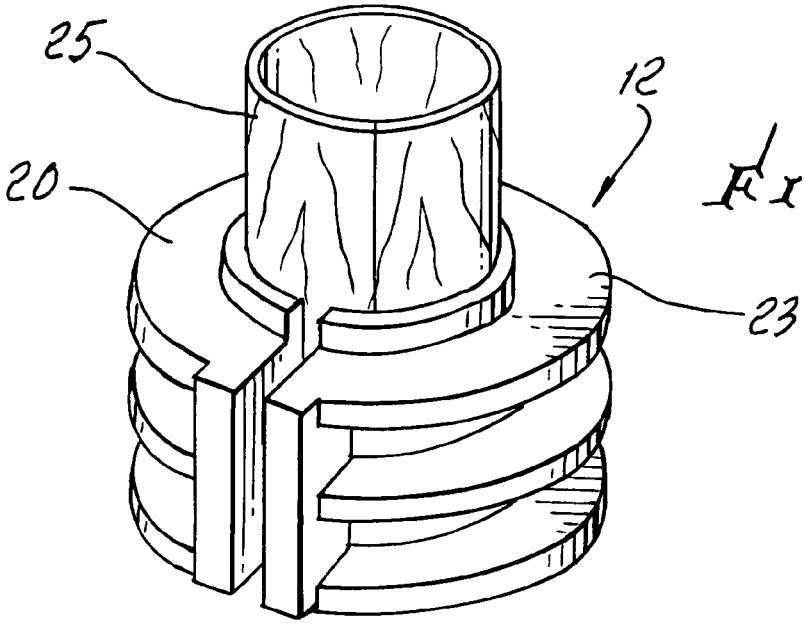
FIG. 11 is a top perspective view showing a formed drum shell during removal from between the inner and outer platens.

FIGS. 7-9 show actual inner and outer platens 10 and 12, and coolant ducts or tubes 26. FIG. 10 shows in inner tapered plug 30 received in an opening defined by inner platen segments, platens to pressurize these, radially. FIG. 11 axial shows removal of a cooled shell 25 from the platens.

As seen in FIG. 3, the sheet 20 has been deformed to produce a U-shaped bend at 22 between primary set platens 20 and 21, and legs 22*a* projecting rightwardly. FIGS. 4 and 5 show secondary platens 23 and 24 displaced to form the legs 22*a* into continued substantial circularity as related to bend 22. Gap 25 is maintained between the two sets of platens.

I claim:

1. In the method of forming a drum shell that consists of sheet plywood, the steps that include:

a) trapping and forming the shell under pressure and heat into generally cylindrical configuration, b) providing separate sets of inner and outer cooling platens adapted to respectively engage the interior and exterior surfaces of the heated shell, c) trapping the heated shell between such cooling platens, at elevated pressure, d) allowing the shell to cool while trapped between said cooling platens, at elevated pressure, e) and removing the cooled shell from between the cooling platens, f) said trapping and forming including relatively displacing a primary set of inner and outer semi-circular platens toward one another to trap and progressively deform the sheet plywood into U-shape having leg portions projecting in generally parallel relation from a bend formed between the primary platens, and thereafter relatively displacing a secondary set of inner and outer semi-circular platens toward one another, then toward the primary platens to trap and progressively deform the sheet plywood leg portions into semi-circular shape, there being a gap maintained between the primary and secondary set platens.

2. The method of claim 1 including transferring heat from the shell side wall or walls to the cooling platens during such cooling.

3. The method of claim 1 including cooling the cooling platens during said heat transfer.

4. The method of claim 3 including passing coolant liquid in heat transfer relation with the cooling platens during said transfer of heat from the shell to the cooling platens.

5. The method of claim 2 including maintaining the rate of heat transfer from different portions of the shell, and sidewardly thereof, to sides of the cooling platens, substantially constant during said cooling.

6. The method of claim 1 wherein said elevated pressure is in excess of 1,000 psi.

7. The method of claim 5 wherein said elevated pressure is in excess of 1,000 psi.

8. The method of claim 1 wherein said elevated pressure is in excess of 2,000 psi.

9. The method of claim 1 wherein each of said inner and outer platens has circular segment configuration.

10. The method of forming a drum shell consisting of plywood, the steps that include:

a) providing first inner and outer shell forming semi-circular platens, in two sets, b) trapping plywood between the two sets of platens at elevated temperature and pressure to annularly form the drum shell, by displacing one set of inner and outer semi-circular platens toward one another to trap and progressively deform the plywood into U-shape having leg portions projecting in generally parallel relation from a bend formed between said one set of inner and outer semi-circular platens, and thereafter displacing another set of inner and outer semi-circular platens toward one another, then toward said one set of inner and outer semi-circular platens to trap and progressively deform the plywood leg portions into semi-circular shape, while maintaining a gap between said two sets of inner and outer semi-circular platens, c) providing second inner and outer shell cooling platens, d) trapping the formed shell in heated state between the second platens at elevated pressure, e) allowing the shell to cool between the second platens, by heat transfer sidewardly of the shell to second platens, while remaining at elevated pressure, and f) removing the cooled shell from between the inner and outer second platens.

11. The method of claim 10 including transferring heat from the second platens to cooling liquid during said e) step.

12. The method of claim 10 wherein each of said first platens has multiple circular segment configuration.

13. The method of claim 10 wherein each of said second platens has multiple circular segment configuration.

14. The method of claim 10 wherein multiple of said first platens are provided in a first bank, and multiple of said second platens are provided in a second bank, and wherein the following steps are included:

f) multiple heated shells are transferred from the first bank to the second bank, for cooling in accordance with steps d) and e), and multiple cooled shells are removed from the second bank, for further processing.

* * * * *